US012077896B2

(12) United States Patent
Jiang et al.

(10) Patent No.: US 12,077,896 B2
(45) **Date of Patent: *Sep. 3, 2024**

(54) LAUNDRY TREATING APPLIANCE DETERGENT DISPENSER

(71) Applicant: WHIRLPOOL CHINA CO., LTD., Hefei (CN)

(72) Inventors: Wenqiang Jiang, Hefei (CN); Guang Yang, Hefei (CN); Huaijun Tong, Hefei (CN); Xiaoqian Yao, Hefei (CN); Yujin Mao, Hefei (CN)

(73) Assignee: Whirlpool China Co., LTD., Hefei (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/103,581

(22) Filed: Jan. 31, 2023

(65) Prior Publication Data

US 2023/0167596 A1 Jun. 1, 2023

Related U.S. Application Data

(63) Continuation of application No. 17/203,900, filed on Mar. 17, 2021, now Pat. No. 11,591,739, which is a continuation of application No. 15/780,332, filed as application No. PCT/US2016/064157 on Nov. 30, 2016, now Pat. No. 10,988,886.

(30) Foreign Application Priority Data

Dec. 22, 2015 (CN) ..... 201510981556.8

(51) Int. Cl.

| | |
|---|---|
| ***D06F 39/02*** | (2006.01) |
| ***D06F 39/08*** | (2006.01) |
| ***D06F 39/12*** | (2006.01) |

(52) U.S. Cl.

CPC ..... *D06F 39/02* (2013.01); *D06F 39/022* (2013.01); *D06F 39/12* (2013.01); *D06F 39/088* (2013.01)

(58) Field of Classification Search

None

See application file for complete search history.

(56) References Cited

U.S. PATENT DOCUMENTS

| | | | |
|---|---|---|---|
| 3,567,076 | A | 3/1971 | Zanussi |
| 3,696,970 | A | 10/1972 | Bunnell et al. |

(Continued)

FOREIGN PATENT DOCUMENTS

| | | | |
|---|---|---|---|
| CN | 205443676 | U | 8/2016 |
| EP | 2003237 | A1 | 12/2008 |

OTHER PUBLICATIONS

International Search Report and Written Opinion of the Searching Authority for Counterpart PCT/US2016/064157, Dated Mar. 19, 2017.

(Continued)

*Primary Examiner* — Levon J Shahinian

(74) *Attorney, Agent, or Firm* — McGarry Bair PC

(57) ABSTRACT

A clothes washing machine includes a cabinet defining an interior and having a top wall with a dispenser opening, and a water inlet box located within the interior and having a storage cartridge chamber accessible through the dispenser opening. The storage cartridge can be removably mountable within the storage cartridge chamber through the dispenser opening.

20 Claims, 9 Drawing Sheets

(56) References Cited

U.S. PATENT DOCUMENTS

| | | | | |
|---|---|---|---|---|
| 7,950,088 | B2 | 5/2011 | Dalton et al. | |
| 8,074,476 | B2 | 12/2011 | Quandt | |
| 9,181,650 | B2 | 11/2015 | D'Andrea et al. | |
| 10,988,886 | B2 * | 4/2021 | Jiang | D06F 39/12 |
| 11,591,739 | B2 * | 2/2023 | Jiang | D06F 39/12 |
| 2010/0000264 | A1 | 1/2010 | Luckman et al. | |
| 2010/0107704 | A1 | 5/2010 | Seo et al. | |
| 2013/0175293 | A1 | 7/2013 | Burgess | |
| 2013/0240049 | A1 | 9/2013 | Dalton et al. | |
| 2014/0190216 | A1 | 7/2014 | Leibman et al. | |
| 2014/0190220 | A1 | 7/2014 | Lee et al. | |
| 2015/0059417 | A1 | 3/2015 | Ramasco | |

OTHER PUBLICATIONS

European Search Report for Counterpart EP16879846.0, Dated Sep. 2, 2019.

* cited by examiner

LAUNDRY TREATING APPLIANCE DETERGENT DISPENSER

CROSS REFERENCE TO RELATED APPLICATIONS

This application is a continuation of U.S. patent application Ser. No. 17/203,900, filed Mar. 17, 2021, now U.S. Pat. No. 11,591,739, issued Feb. 28, 2023, which is a continuation of U.S. patent application Ser. No. 15/780,332, filed May 31, 2018, now U.S. Pat. No. 10,988,886, issued Apr. 27, 2021, which claims priority to International Application No. PCT/US2016/064157, filed Nov. 30, 2016, which claims priority to Chinese Application No. 201510981556.8, filed Dec. 22, 2015, the entirety of all of which are incorporated herein by reference.

BACKGROUND

At present, the detergent dispensing system of automatic washing machines mostly adopts the method of dispensing from the front drawer, which is to arrange a drawer in the upper left area of the front panel of a washing machine. Inside the drawer, there are several chambers to load detergents. Washing machines with automatic dispensing functions in the market commonly adopt this kind of design, wherein the drawer or the storage cartridge is removed in a horizontal direction.

BRIEF SUMMARY

In one aspect, the disclosure relates to a dispenser for a clothes washing machine having an interior with a tub and a dispenser opening. The dispenser has a water inlet box located within the interior and having a storage cartridge chamber accessible through the dispenser opening, and also having a powder detergent chamber accessible through the dispenser opening and fluidly coupled to the tub, a storage cartridge removably mountable within the storage cartridge chamber through the dispenser opening and fluidly coupled to the tub, wherein the storage cartridge comprises multiple, fluidly isolated treating chemistry chambers, and multiple metering pumps, wherein each metering pump of the multiple metering pumps has an inlet fluidly coupled to each corresponding treating chemistry chamber of the multiple treating chemistry chambers.

In another aspect, the disclosure relates to a dispenser for a clothes washing machine having a cabinet defining an interior and having a top wall with a dispenser opening and a tub located within the interior. The dispenser has a water inlet box located within the interior and having a storage cartridge chamber accessible through the dispenser opening, and also having a powder detergent chamber accessible through the dispenser opening and fluidly coupled to the tub, and a storage cartridge removably mountable within the storage cartridge chamber through the dispenser opening and fluidly coupled to the tub, a first metering pump positioned on a first side of the dispenser and having a first inlet fluidly coupled to the storage cartridge, and a second metering pump positioned on one of the first side or a second side of the dispenser and having a second inlet fluidly coupled to the storage cartridge.

In another aspect, the disclosure relates to a dispenser for a clothes washing machine having a cabinet defining an interior and having a top wall with a dispenser opening. The dispenser has a water inlet box located within the interior, the water inlet box having a common detergent chamber and a storage cartridge chamber accessible through the dispenser opening; a storage cartridge removably mountable within the storage cartridge chamber through the dispenser opening and having a handle, the storage cartridge having at least two fluidly isolated bulk treating chemistry chambers, a set of first fluid connectors on the storage cartridge, with each of the at least two fluidly isolated bulk treating chemistry chambers having a first fluid connector of the set of first fluid connectors, and a set of second fluid connectors in the water inlet box, wherein each first fluid connector in the set of first fluid connectors couples to a corresponding second fluid connector in the set of second fluid connectors when the storage cartridge is positioned within the water inlet box, and wherein each first fluid connector in the set of first fluid connectors is fluidly coupled to the common detergent chamber of the water inlet box.

DETAILED DESCRIPTION

Figure 1:
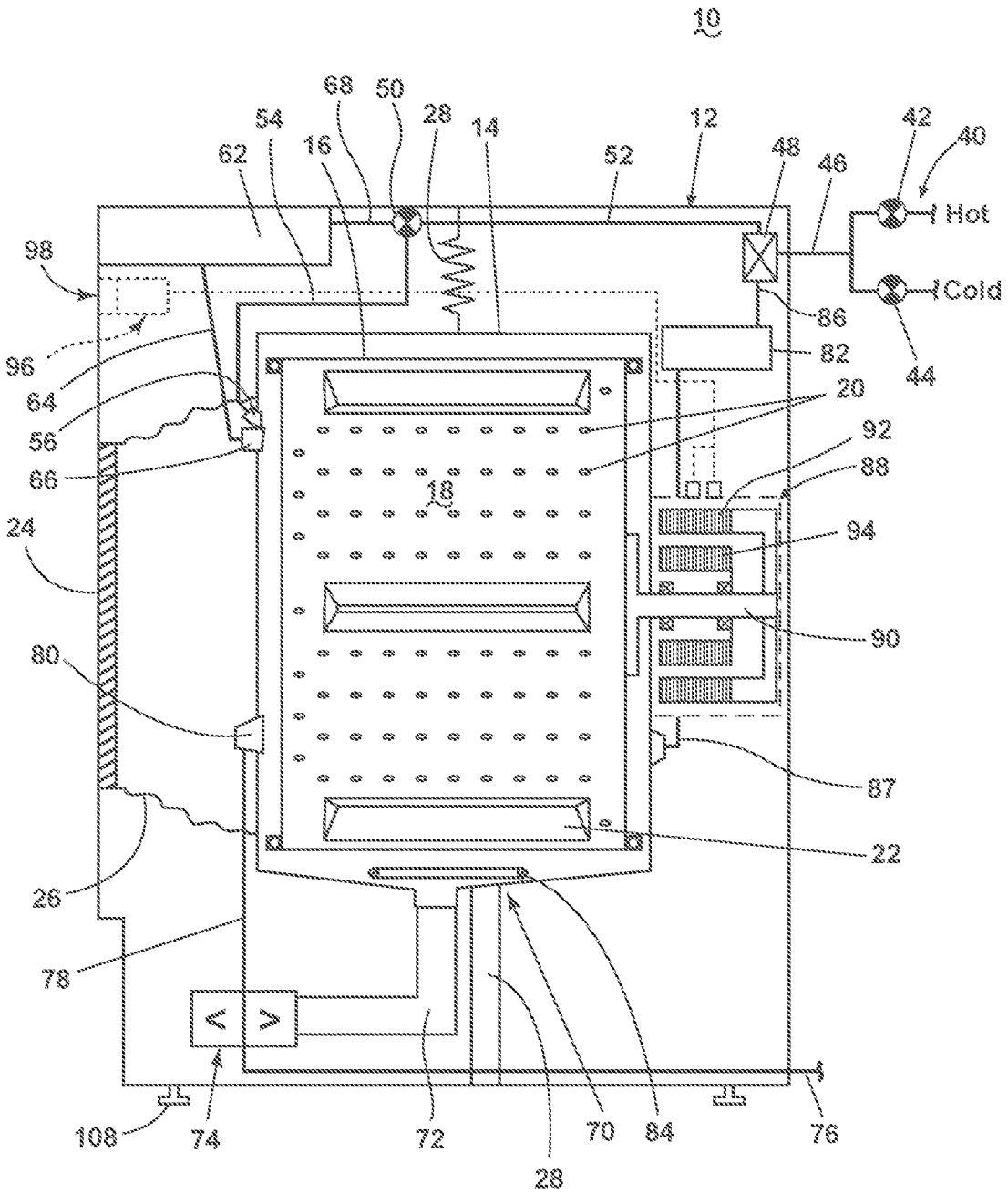
FIG. 1 is a schematic view of a laundry treating appliance in the form of a front-loading, horizontal axis washing machine.

FIG. 1 shows a laundry treating appliance in accordance with the present disclosure, which happens to be a horizontal axis automatic clothes washing machine 10. Although much of the remainder of this application will focus on the embodiment of the horizontal axis automatic clothes washing machine 10, the present disclosure encompasses other environments, including other horizontal axis laundry treating appliances such as a laundry dryer. Also, while illustrated as a front-loading, horizontal axis laundry treating appliance, other loading configurations, such as top-loading are contemplated.

Further, other axes of rotation are contemplated. A vertical axis laundry treating appliance is contemplated in addition to the illustrated horizontal axis laundry treating appliance. For purposes of this description, the terms horizontal axis and vertical axis are used to represent the general orientation of the axis of rotation and is not meant to be limited to a perfectly horizontal or vertical axis of rotation. More accurately, the terms horizontal axis of rotation or vertical axis of rotation, when used to identify the type of laundry treating appliance, are more accurately used to describe the primary mechanism by which mechanical energy is imparted to the laundry. The horizontal axis washing machine imparts mechanical energy primarily by tumbling the laundry within the drum. That is, rotation of the drum lifts and then drops the laundry. This lifting/dropping imparts mechanical energy to the laundry. The vertical axis washing machine imparts mechanical energy via a clothes mover, such as an agitator, impeller, pulsator, auger, etc., which is rotated within the basket to effect movement of liquid in the basket or directly impact the laundry. While a laundry container is normally referred to as a drum for a horizontal axis machine and a basket for a vertical axis machine, for this disclosure, unless otherwise stated, drum and basket are interchangeable.

The laundry treating appliance of FIG. 1 is illustrated as a front-loading, horizontal-axis washing machine 10, which may include a structural support system comprising a cabinet 12 which defines a housing within which a laundry holding system resides and includes a top wall 13. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system 28 and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 and can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14.

The washing machine 10 can also be provided with a dispensing system for dispensing treating chemistry to the treating chamber 18 for use in treating the laundry according to a cycle of operation. The dispensing system can include a dispenser 62, which can be a single use dispenser, a bulk dispenser or a combination of a single use and bulk dispenser.

The dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the dispenser 62 from the supply conduit 52 by directing the second diverter mechanism 50 to direct the flow of water to a dispensing supply conduit 68.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The washing machine 10 can also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 88 for rotationally driving the drum 16. The motor 88 can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled with the drum 16 through a belt and a drive shaft 90 to rotate the drum 16, as is known in the art. Other motors, such as an induction motor or a permanent split capacitor (PSC) motor, can also be used. The motor 88 can rotationally drive the drum 16 including that the motor 88 can rotate the drum 16 at various speeds in either rotational direction. The motor 88 can be configured to rotatably drive the drum 16 in response to a motor control signal.

The washing machine 10 also includes a control system for controlling the operation of the washing machine 10 to implement one or more cycles of operation. The control system can include a controller 96 located within the cabinet 12 and a user interface 98 that is operably coupled with the controller 96. The user interface 98 can include one or more knobs, dials, switches, displays, touch screens, and the like for communicating with the user, such as to receive input and provide output. The user can enter different types of information including, without limitation, laundry treating chemistry concentration and cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller can be a microprocessor-based controller that implements control software and sends/receives one or more electrical signals to/from each of the various working components to effect the control software.

Figure 2:
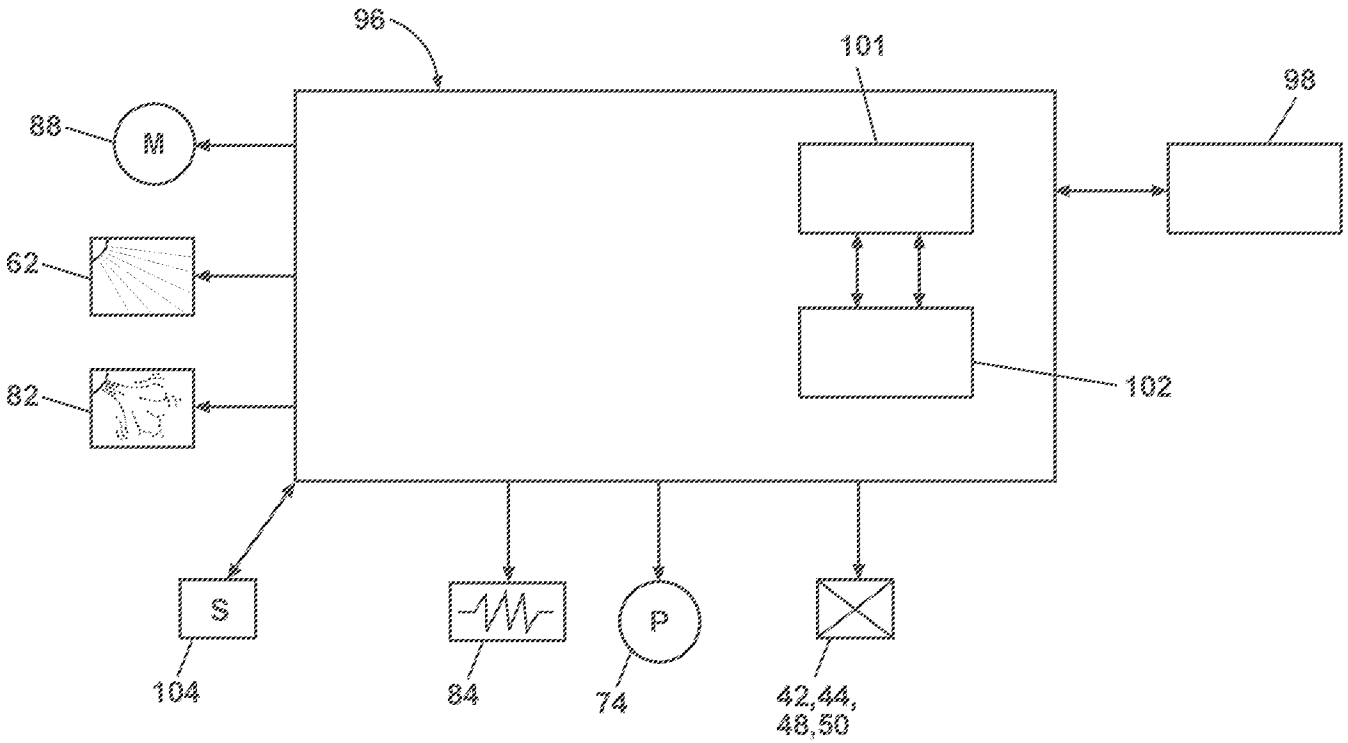
FIG. 2 is a schematic view of a controller of the washing machine in FIG. 1.

As illustrated in FIG. 2, the controller 96 can also be coupled with one or more sensors 103, 104 provided in one or more of the systems of the washing machine 10 to receive input from the sensors. Non-limiting examples of sensors 103, 104 that can be communicably coupled with the controller 96 include: a surfactant sensor, a turbidity sensor, a motor torque sensor, a pressure sensor, a conductivity sensor, a treating chamber temperature sensor, a moisture sensor, a weight sensor, a chemical sensor, a position sensor, an acceleration sensor, a speed sensor, an orientation sensor, an imbalance sensor, a load size sensor, and, which can be used to determine a variety of system and laundry characteristics, such as over-sudsing conditions.

For example, a motor torque sensor, a speed sensor, an acceleration sensor, and/or a position sensor can also be included in the washing machine 10 and can provide an output or signal indicative of the torque applied by the motor, a speed of the drum 16 or component of the drive system, an acceleration of the drum 16 or component of the drive system, and a position sensor of the drum 16. Such sensors 103, 104 can be any suitable types of sensors including, but not limited to, that one or more of the sensors 103, 104 can be a physical sensor or can be integrated with the motor and combined with the capability of the controller 96 to function as a sensor. For example, motor characteristics, such as speed, current, voltage, torque etc., can be processed such that the data provides information in the same manner as a separate physical sensor. In contemporary motors, the motors often have their own controller that outputs data for such information.

The controller 96 can be provided with a memory 101 and a central processing unit (CPU) 102. The memory 101 can be used for storing the control software that can be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 101 can also be used to store information, such as a database or table, and to store data received from one or more components or sensors 103, 104 of the washing machine 10 that can be communicably coupled with the controller 96. The database or table can be used to store the various operating parameters for the one or more cycles of operation, including factory default values for the operating parameters and any adjustments to them by the control system or by user input. Such operating parameters and information stored in the memory 101 can include, but are not limited to, threshold values, predetermined criteria, acceleration ramps, etc.

The controller 96 can be operably coupled with one or more components of the washing machine 10 for communicating with and controlling the operation of the component to complete a cycle of operation. For example, the controller 96 can be operably coupled with the motor 88, the pump 74, the dispenser 62, the steam generator 82 and the sump heater 84 to control the operation of these and other components to implement one or more of the cycles of operation.

Figure 3:
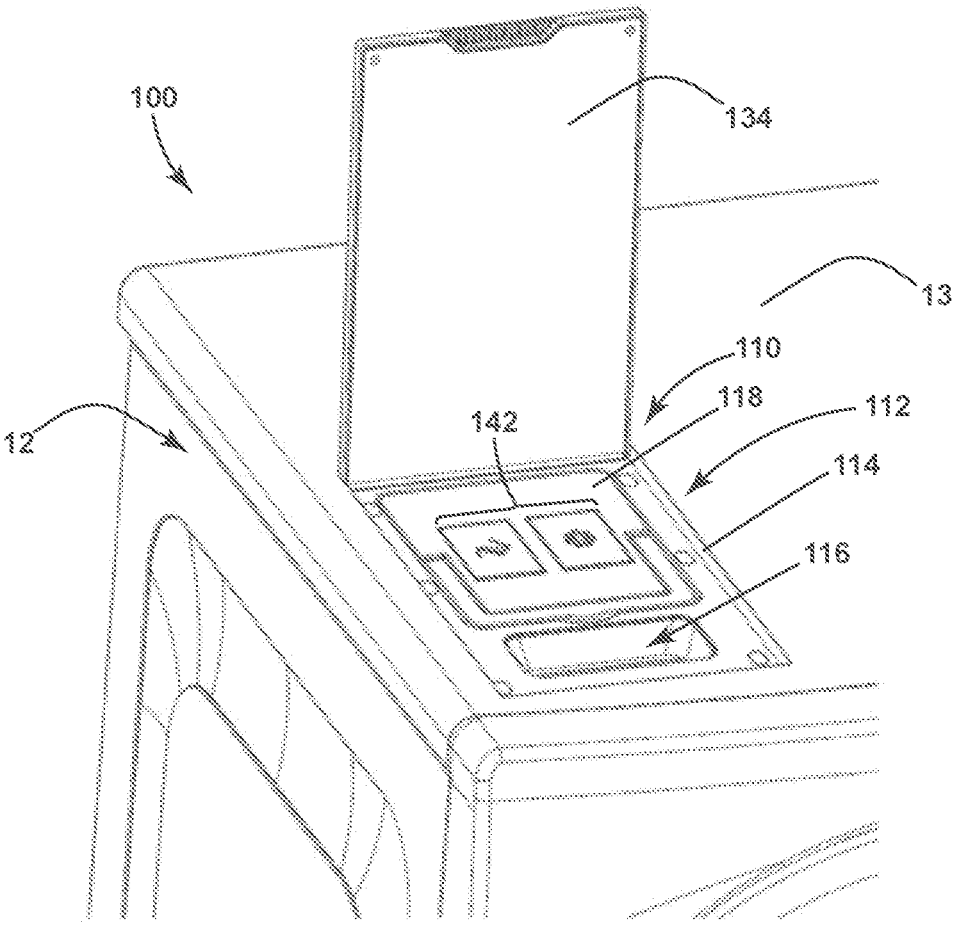
FIG. 3 is a top, perspective view of a dispenser according to an embodiment of the disclosure.

In order to achieve the above purpose, the present invention has applied the following technical schemes for the dispenser 62. One possible implementation of the dispenser 62 is illustrated in FIG. 3 in the form of a dispenser 100. The dispenser 100 includes a water inlet box 112. The water inlet box 112 can include a storage cartridge 118 having fill opening lids 154 and a handle 156, a powder detergent chamber 116, and a cover 134. The water inlet box 112 is installed on the left front area of the top wall 13 of the cabinet 12 of the washing machine 10. In the front of the water inlet box 112 is the powder detergent chamber 116, a chamber is designed for manual dispensing that can receive either powder or liquid detergent. In the rear of the water inlet box 112, a storage cartridge chamber 114 is used for inserting the storage cartridge 118. The cover 134 is movably mounted relative to the cabinet 12 to selectively open and close a dispenser opening 110. The storage cartridge chamber 114 and the powder detergent chamber 116 can be accessible through the dispenser opening 110.

Figure 4:
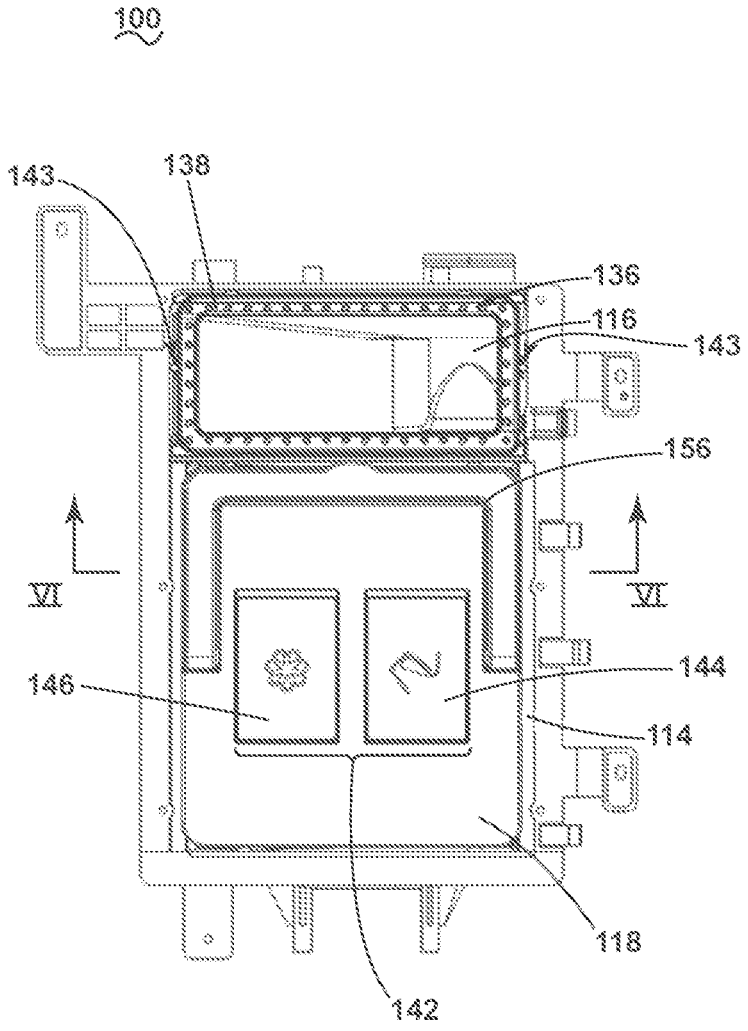
FIG. 4 is top view of the dispenser of FIG. 3, shown without the washing machine cabinet.

Turning to FIG. 4, the storage cartridge 118 can have multiple fluidly isolated treating chemistry chambers 142 that can be used to store detergent. The treating chemistry chambers 142 can be in the form of a bulk liquid detergent chamber 144 and in the form of a bulk fabric softener chamber 146. While shown in the form of a liquid detergent chamber 144 and a fabric softener chamber 146, the treating chemistry chambers 142 can include dual liquid detergent chambers 144, or any combination of treating chemistry chambers suitable for the desired needs of the user. The powder detergent chamber 116 can include a water distributor 136 in the form of a shower head or shower assembly that provides water to flush out powder detergent. As illustrated, the shower head 136 is an annular structure, and can include an annulus 138 circumscribing the powder detergent chamber 116. It is installed and positioned to the water inlet box 112 by jaw and guide ribs 143.

Figure 5:
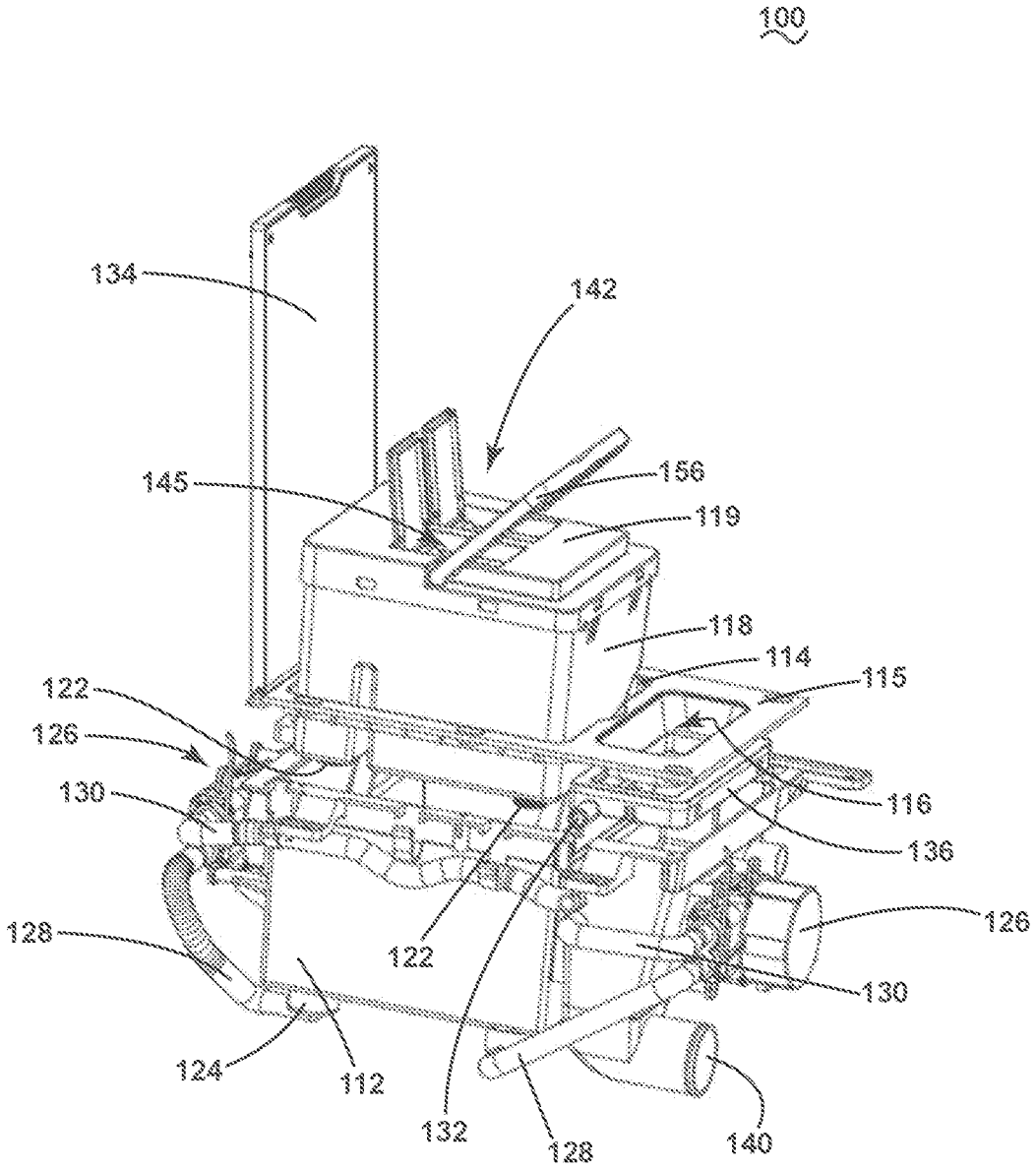
FIG. 5 is a perspective, exploded view of the dispenser of FIG. 3, shown without the washing machine cabinet.

FIG. 5 illustrates more clearly the storage cartridge 118 including the storage cartridge chamber 114, a decorative cover 115 for the water inlet box 112, metering pumps 126 and pipelines. The pipelines include a water supply line 132, metering pump inlets 128, metering pump outlets 130, and a drain outlet 140. Each of the treating chemistry chambers 142 includes a fill opening 145 wherein the fill opening lid 154 selectively provides access to the corresponding fill opening 145 so that the treating chemistry chambers 142 are refillable. At the front part of the said decorative cover 115, there is a dispensing orifice 116 for dispensing washing powder, and in the rear there is a hollow region for limiting the storage cartridge assembly 114. The decorative cover 115 and the water inlet box 112 are fixed with screw connection. The opening area of the cover is installed between the decorative cover 115 and the water inlet box 112 and the cover opening edge is sealed directly with the decorative cover 115.

Each of the treating chemistry chambers 142 includes a pump connection. The pump connection can include the metering pump 126. The metering pump inlet 128 can be fluidly coupled to the second connector 124 and a metering pump outlet 130 can be fluidly coupled to the water inlet box 112. A water supply line 132 can be fluidly coupled to the water inlet box 112 and the powder detergent chamber 116 to flush at least the powder detergent chamber 116. The metering pump outlet 130 can be fluidly coupled to the powder detergent chamber 116. The water supply line 132 can terminate in the water distributor 136 fluidly coupled to the powder detergent chamber 116. The drain outlet 140 can be located in the powder detergent chamber 116 and be fluidly coupled to the tub 16. The metering pump inlet 128 allows the flow of treating chemistry into the metering pump 126 and the metering pump outlet 128 can flow the treating chemistry or a mixture of treating chemistry and water to the powder detergent chamber 116 where the treating chemistry can be flushed with water from the shower head 136.

A liquid coupling allows treating chemistry to flow from the treating chemistry chamber 124 to the metering pump inlet 128. The liquid coupling for each of the treating chemistry chambers 142 includes a first connector 122 provided on the storage cartridge 118 and a second connector 124 provided in the storage cartridge chamber 114. The first connector 122 and the second connector 124 couple when the storage cartridge 118 is mounted within the storage chamber 114 to establish a liquid connection. The storage cartridge 118 is removably mountable within the storage cartridge chamber 114 and can be removed through the dispenser opening 110 in a vertical direction when a user grasps the handle 156, which decouples the first connector 122 and the second connector 124 of the liquid coupling and raises the storage cartridge 118 out of the storage cartridge chamber 114. Alternately, the storage cartridge 118 can be inserted through the dispenser opening 110 in the top wall 13 of the cabinet 12 when a user lowers the storage cartridge 118 into the storage cartridge chamber 114, which couples the first connector 122 and the second connector 124 of the liquid coupling. The handle 156 can be mounted to the storage cartridge 118, and for example, can be pivotally mounted to the storage cartridge 118. A handle is provided on the storage lid. The storage cartridge is connected with the storage lid by the jaw and each liquid storage chamber has a floater.

Figure 6:
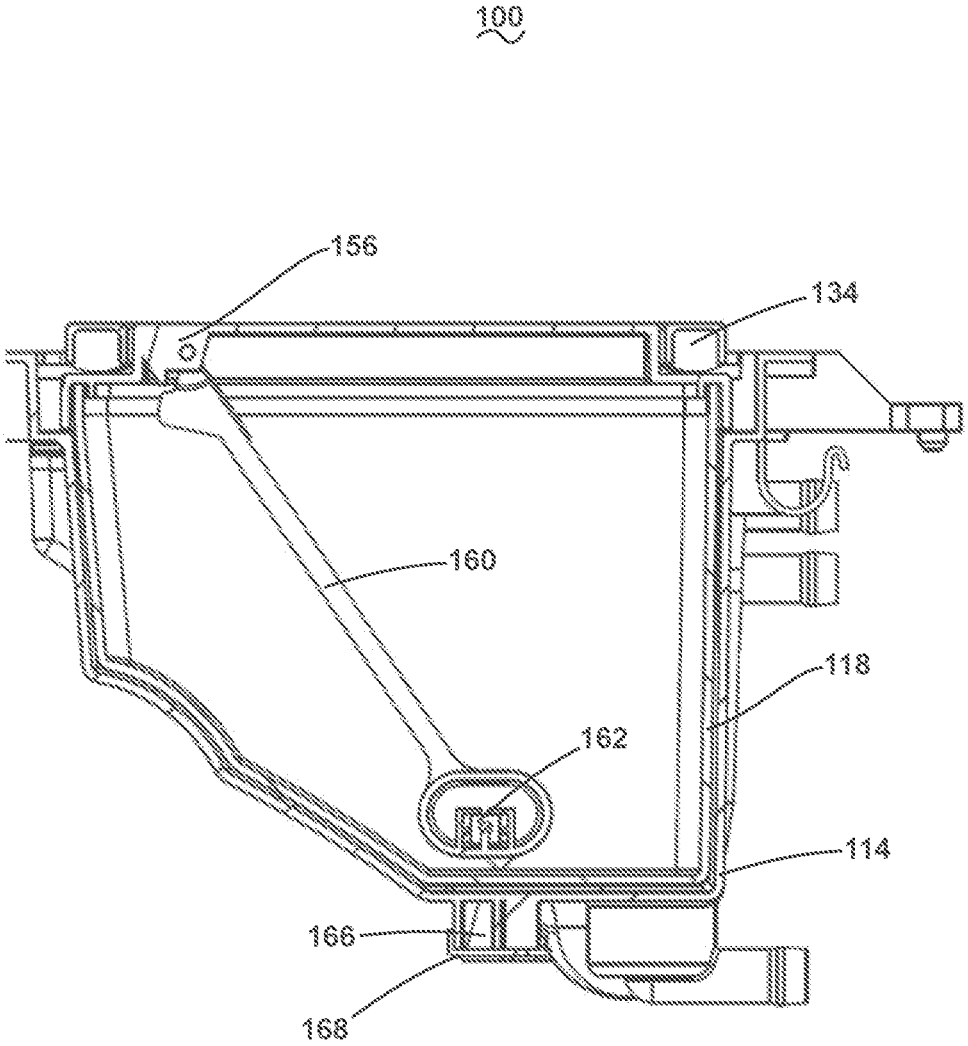
FIG. 6 is a cross-section along line VI-VI in FIG. 4.

Turning to FIG. 6, inside the storage cartridge 118, a liquid level sensor in the form of a floater device 160, or floater or float, is installed to detect the height of the liquid. By the principle of buoyancy, the floater 160 measures the height of the liquid by the distance between magnets 162 and magnetic switches 166. One end of the float 160 cooperates with the storage lid axle hole and the two form a cantilever. The cavity on the other end and the float cover are sealed by welding, and magnets 162 are installed in the interior space generated; magnetic switches 166 as well as fixed plates 168 for fixing magnetic switches 166 are installed in the corresponding positions at the bottom of the said water inlet box 112. When the liquid level is low, the magnets 162 in the liquid level sensor 160 activate the magnetic switches 166, which can turn on a warning light to warn a user of a low liquid level.

Figure 7:
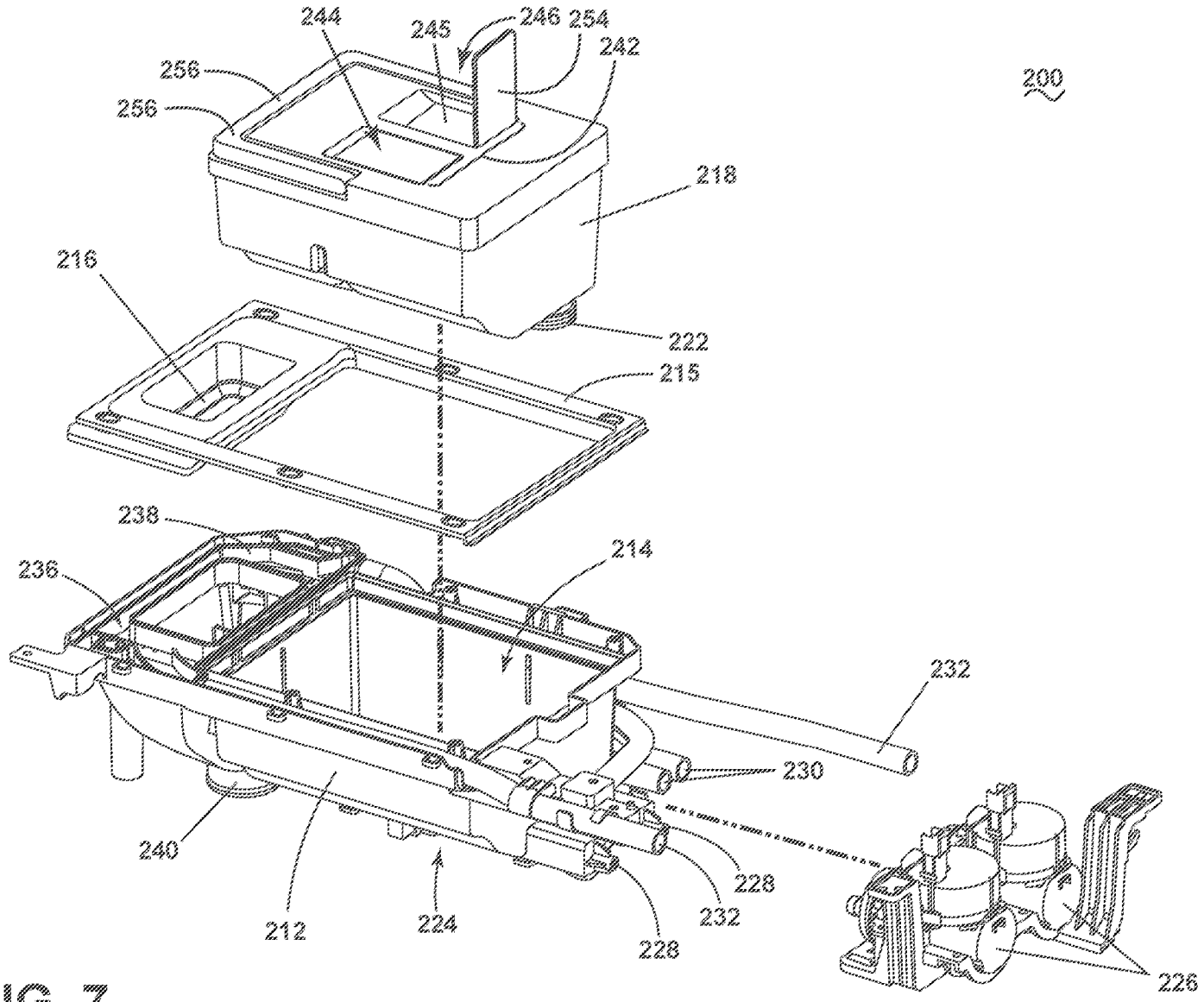
FIG. 7 is an exploded view of a dispenser according to another embodiment of the disclosure.

Another exemplary dispenser 200 according to aspects of the present disclosure is illustrated in FIG. 7. The dispenser 200 is similar to the dispenser 100; therefore, like parts will be identified with like numerals increased by 100, with it being understood that the description of the like parts of the dispenser 100 applies to water inlet box 200, unless otherwise noted. The dispenser 200 differs from the dispenser 100 with respect to the metering pumps 226.

The dispenser 200 includes a water inlet box 212. The water inlet box 212 can include a storage cartridge 218 having fill opening lids 254 and a handle 256, and a powder detergent chamber 216. A storage cartridge chamber 214 is configured for inserting the storage cartridge 218. A cover can be movably mounted relative to the cabinet 12 to selectively open and close a dispenser opening. The storage cartridge chamber 214 and the powder detergent chamber 216 can be accessible through the dispenser opening.

The storage cartridge 218 can have multiple fluidly isolated treating chemistry chambers 242 that can be used to store detergent. The treating chemistry chambers 242 can be in the form of a bulk liquid detergent chamber 244, which can hold any desired treating chemistry, and can be in the form of a bulk fabric softener detergent chamber 246, for example. The powder detergent chamber 216 can include a water distributor 236 in the form of a shower head or shower assembly that provides water to flush out powder detergent. As illustrated, the shower head 236 is an annular structure, and can include an annulus 238 circumscribing the powder detergent chamber 216.

The storage cartridge 218 including the storage cartridge chamber 214, a decorative cover 215 for the water inlet box 212, a first connector 222, metering pumps 226 and pipelines. The pipelines include a water supply line 232, metering pump inlets 228, metering pump outlets 230, and a drain outlet 240. Each of the treating chemistry chambers 242 includes a fill opening 245 wherein the fill opening lid 254 selectively provides access to the corresponding fill opening 245 so that the treating chemistry chambers 242 are refillable.

Each of the treating chemistry chambers 242 includes a pump connection. The pump connection can include the metering pumps 226. Each bulk treating chemistry chamber 242 includes a metering pump 226. In this embodiment, the metering pumps 226 are on the same side of the dispenser 200 rather than on opposite sides as in dispenser 100. Since the metering pumps 226 are on the same side of the dispenser 200, which is towards the interior of the cabinet 12, the dispenser 200 can fit in a more forward position, towards the exterior, of the top wall 13 of the cabinet 12. It can be advantageous to have the dispenser 200 closer to the exterior of the top wall 13 so that the user can be closer to the dispenser 200. The metering pump inlet 228 can be fluidly coupled to the second connector 224 and a metering pump outlet 230 can be fluidly coupled to the water inlet box 212. A water supply line 232 can be fluidly coupled to the water inlet box 212 and the powder detergent chamber 216 to flush at least the powder detergent chamber 216. The metering pump outlet 230 can be fluidly coupled to the powder detergent chamber 216. The water supply line 232 can terminate in the water distributor 236 fluidly coupled to the powder detergent chamber 216. The drain outlet 240 can be located in the powder detergent chamber 216 and be fluidly coupled to the tub 16. The metering pump inlet 228 allows the flow of treating chemistry into the metering pump 226 and the metering pump outlet 228 can flow the treating chemistry or a mixture of treating chemistry and water to the powder detergent chamber 216 where the treating chemistry can be flushed with water from the shower head 236.

A liquid coupling allows treating chemistry to flow from the treating chemistry chamber 224 to the metering pump inlet 228. The liquid coupling for each of the treating chemistry chambers 242 includes a first connector 222 provided on the storage cartridge 218 and a second connector 224 provided on the storage cartridge chamber 214. The first connector 222 and the second connector 224 conjoin when the storage cartridge 218 is mounted within the storage chamber 214 to establish a liquid connection. The storage cartridge 218 is removably mountable within the storage cartridge chamber 214 and can be removed through the dispenser opening 210 in a vertical direction when a user grasps the handle 256, which decouples the first connector 222 and the second connector 224 of the liquid coupling and raises the storage cartridge 218 out of the storage cartridge chamber 214. Alternately, the storage cartridge 218 can be inserted through the dispenser opening 210 in the top wall 13 of the cabinet 12 when a user lowers the storage cartridge 218 into the storage cartridge chamber 214, which conjoins the first connector 222 and the second connector 224 of the liquid coupling 270. The handle 256 can be mounted to the storage cartridge 218, and for example, can be pivotally mounted to the storage cartridge 218.

Figure 8:
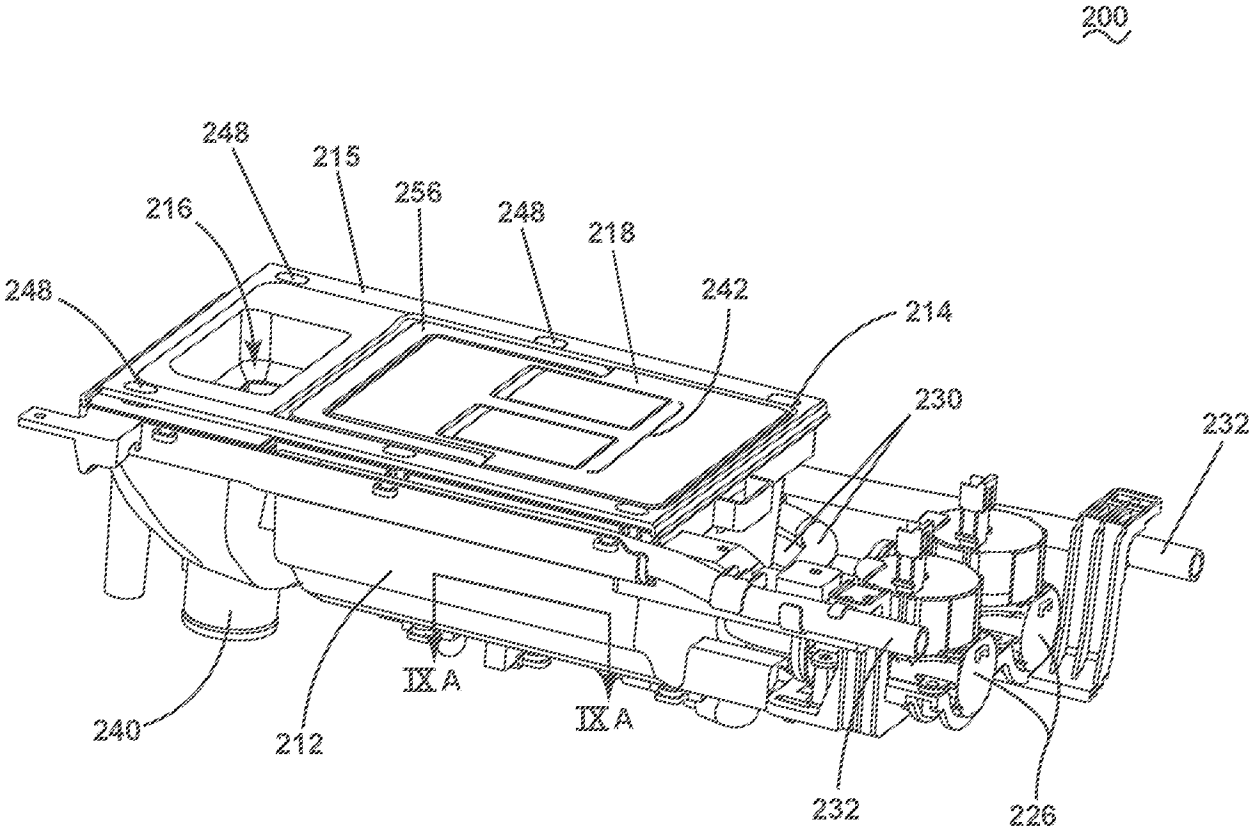
FIG. 8 is a perspective view of the dispenser of FIG. 7.

FIG. 8 is an assembled view of the dispenser 200 in FIG. 7. The decorative cover 215 couples the water inlet box 212 and can be fastened with any suitable fastener, such as screws 248. The storage cartridge 218 is inserted within the storage cartridge chamber 214, thus the liquid connection is formed.

Figure 9B:
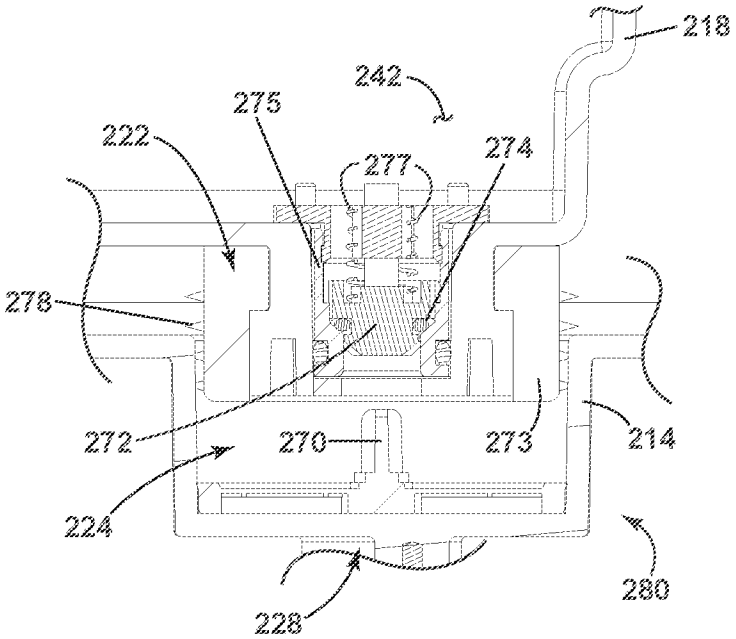
FIG. 9B illustrates the liquid coupling of FIG. 9A uncoupled according to an embodiment of the disclosure.
Figure 9A:
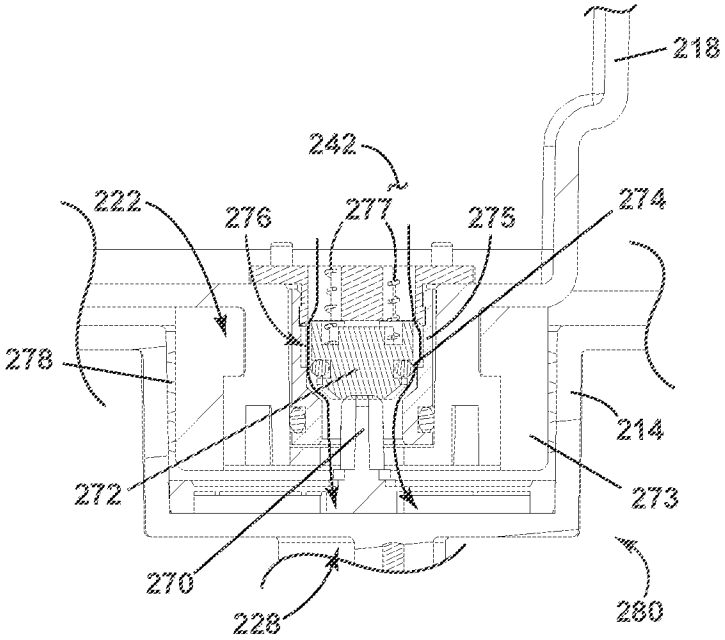
FIG. 9A is a cross-section along line IX-IX in FIG. 8 illustrating a liquid coupling according to an embodiment of the disclosure.

FIG. 9A shows a cross-section of the water inlet box 212 along line IX-IX of FIG. 8 to illustrate the liquid coupling 280 more clearly. A piston 270 on the second connector 224 abuts a seal 272 having a spring 277 on the first connector 222. A gasket 274 circumscribes the seal 272 and is adjacent an inner wall 275 of the first connector 222. An outer wall 273 of the first connector includes flexible, annular ribs 278. The annular ribs 278 can be constructed of a rubber, or any other suitable material. While the first connector 222 and second connector 224 are coupled to form the liquid coupling 280, a liquid connection results and treating chemistry is permitted to flow from first connector 222 to the second connector 224. Furthermore, the treating chemistry can flow to the metering pump inlet 228.

The first connector 222 and the second connector 224 establish the liquid connection when the storage cartridge 218 is inserted within the storage chamber 214. When the storage cartridge 218 is inserted within the storage chamber 214, the piston 270 on the second connector 224 abuts the seal 272 on the first connector 222. The piston 270 counteracts the force from the spring so that the seal 272 moves upwards and gasket 274 is decompressed and does not abut the inner wall 275. When the seal 272 moves upwards, a channel 276 is formed between the inner wall 275 and the seal 272, which allows treating chemistry to flow to the second connector 224 and the metering pump inlet 228 as indicated by the arrows. The annular ribs 278 on the outer wall 273 of the first connector 222 can flex, or bend to fit within the storage cartridge chamber 114 and form a secondary seal between the first connector 222 and the second connector 224.

FIG. 9B illustrates the liquid coupling 280 of FIG. 9A, uncoupled. While uncoupled, the piston 270 does not abut the seal 272. The spring 277 provides force to compress the gasket 274 so that it abuts the inner wall 275. Thus, the channel 276 is not formed, and the liquid connection is not established. Treating chemistry cannot flow from the first connector 222 to the second connector 224.

From the above technical scheme, it thus clear that the present invention has designed the water inlet box assembly in the cover region of a washing machine. It makes the design of the front panel simpler. It also features removable storage cartridge assembly which makes it more convenient for users to clean.

The aspects of the disclosure described herein relate to a water inlet box assembly, comprising a manual dispenser and a liquid storage cartridge, in the form of a storage cartridge. The storage cartridge 118 can be removed in a vertical direction, which allows users to remove and clean the storage cartridge 118. Users can add detergent and softener from the top of the washing machine, and remove the storage cartridge in a vertical direction and clean it. From the above technical scheme, it is thus clear that the present invention has changed the water inlet box design of the washing machine from the prior art and has made it more convenient for users to operate.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Combinations or permutations of features described herein are covered by this disclosure.

Although illustrative embodiments of the present invention have been shown and described, it would be appreciated by those skilled in the art that changes may be made in these illustrative embodiments without departing from the principles and spirit of the invention, the scope of which is defined in the claims and their equivalents.

What is claimed is:

1. A dispenser for a clothes washing machine having an interior with a tub and a dispenser opening, the dispenser comprising:

a water inlet box located within the interior and having a storage cartridge chamber accessible through the dispenser opening, and also having a powder detergent chamber accessible through the dispenser opening and fluidly coupled to the tub;

a storage cartridge removably mountable within the storage cartridge chamber through the dispenser opening and fluidly coupled to the tub; wherein the storage cartridge comprises multiple, fluidly isolated treating chemistry chambers; and multiple metering pumps, wherein each metering pump of the multiple metering pumps has an inlet fluidly coupled to each corresponding treating chemistry chamber of the multiple treating chemistry chambers.

2. The dispenser of claim 1, further comprising a first connector located on the storage cartridge and a second connector located in the storage cartridge chamber, with the first and second connectors coupling when the storage cartridge is mounted within the storage cartridge chamber to establish a liquid connection.

3. The dispenser of claim 2, wherein the inlet of the metering pump is fluidly coupled to the first connector.

4. The dispenser of claim 1, further comprising multiple first connectors, with each first connector of the multiple first connectors located in a corresponding treating chemistry chamber of the multiple treating chemistry chambers.

5. The dispenser of claim 4, further comprising multiple second connectors, with each second connector of the multiple second connectors coupling to each corresponding first connector of the multiple first connectors when the storage cartridge is mounted within the storage cartridge chamber, thereby establishing multiple liquid connections.

6. The dispenser of claim 1, wherein each metering pump of the multiple metering pumps comprises an outlet fluidly coupled to the powder detergent chamber.

7. The dispenser of claim 1, further comprising a water supply line fluidly coupled to the water inlet box to flush at least the powder detergent chamber.

8. The dispenser of claim 7, further comprising a water distributor fluidly coupled to the water supply line.

9. The dispenser of claim 8, wherein the water distributor is fluidly coupled to the powder detergent chamber.

10. The dispenser of claim 8, wherein the water distributor comprises a shower head.

11. A dispenser for a clothes washing machine having a cabinet defining an interior and having a top wall with a dispenser opening and a tub located within the interior, the dispenser comprising:

a water inlet box located within the interior and having a storage cartridge chamber accessible through the dispenser opening, and also having a powder detergent chamber accessible through the dispenser opening and fluidly coupled to the tub; and a storage cartridge removably mountable within the storage cartridge chamber through the dispenser opening and fluidly coupled to the tub;

a first metering pump positioned on a first side of the dispenser and having a first inlet fluidly coupled to the storage cartridge; and a second metering pump positioned on one of the first side or a second side of the dispenser and having a second inlet fluidly coupled to the storage cartridge.

12. The dispenser of claim 11, wherein the first metering pump further comprises a first outlet fluidly coupled to the powder detergent chamber.

13. The dispenser of claim 12, wherein the second metering pump further comprises a second outlet fluidly coupled to the powder detergent chamber.

14. The dispenser of claim 13, wherein the second metering pump is positioned on the first side of the dispenser.

15. The dispenser of claim 11, wherein the storage cartridge includes a first treating chemistry chamber fluidly separated from a second treating chemistry chamber.

16. The dispenser of claim 15, wherein the first inlet is fluidly coupled to the first treating chemistry chamber and the second inlet is fluidly coupled to the second treating chemistry chamber.

17. The dispenser of claim 11, further comprising a water supply line fluidly coupled to a water distributor.

18. The dispenser of claim 17, wherein the water distributor is fluidly coupled to the powder detergent chamber.

19. A dispenser for a clothes washing machine having a cabinet defining an interior and having a top wall with a dispenser opening, the dispenser comprising:

a water inlet box located within the interior, the water inlet box having a common detergent chamber and a storage cartridge chamber accessible through the dispenser opening;

a storage cartridge removably mountable within the storage cartridge chamber through the dispenser opening and having a handle, the storage cartridge having at least two fluidly isolated bulk treating chemistry chambers;

a set of first fluid connectors on the storage cartridge, with each of the at least two fluidly isolated bulk treating chemistry chambers having a first fluid connector of the set of first fluid connectors; and a set of second fluid connectors in the water inlet box, wherein each first fluid connector in the set of first fluid connectors couples to a corresponding second fluid connector in the set of second fluid connectors when the storage cartridge is positioned within the water inlet box, and wherein each first fluid connector in the set of first fluid connectors is fluidly coupled to the common detergent chamber of the water inlet box.

20. The dispenser of claim 19 wherein the at least two bulk treating chemistry chambers are refillable.

* * * * *